US007721560B2

(12) United States Patent
Carpenter

(10) Patent No.: US 7,721,560 B2
(45) Date of Patent: May 25, 2010

(54) CLIMATE CONTROL AND DEHUMIDIFICATION SYSTEM AND METHOD

(76) Inventor: Frank K. Carpenter, 109 Lovren Dr., White House, TN (US) 37188

( * ) Notice: Subject to any disclaimer, the term of this patent is extended or adjusted under 35 U.S.C. 154(b) by 0 days.

(21) Appl. No.: 11/185,548

(22) Filed: Jul. 20, 2005

(65) Prior Publication Data

US 2006/0026976 A1 Feb. 9, 2006

Related U.S. Application Data

(60) Provisional application No. 60/589,309, filed on Jul. 20, 2004.

(51) Int. Cl.

| | |
|---|---|
| ***F25B 49/00*** | (2006.01) |
| ***F25D 17/04*** | (2006.01) |
| ***F25D 17/06*** | (2006.01) |
| ***G05D 22/02*** | (2006.01) |

(52) U.S. Cl. ..... 62/176.6; 62/176.5; 62/93; 236/44 C

(58) Field of Classification Search ..... 62/176.1, 62/176.6, 176.5, 92, 93; 236/44 C
See application file for complete search history.

(56) References Cited

U.S. PATENT DOCUMENTS

| | | | | |
|---|---|---|---|---|
| 4,105,063 | A | 8/1978 | Bergt | |
| 4,257,238 | A | 3/1981 | Kountz et al. | |
| 4,876,858 | A | 10/1989 | Shaw et al. | |
| 4,889,280 | A | 12/1989 | Grald et al. | |
| 4,942,740 | A | 7/1990 | Shaw et al. | |
| 5,181,387 | A | 1/1993 | Meckler | |
| 5,346,129 | A | 9/1994 | Shah et al. | |
| 5,598,715 | A * | 2/1997 | Edmisten | 62/176.6 |
| 5,622,057 | A * | 4/1997 | Bussjager et al. | 62/173 |
| 5,675,979 | A | 10/1997 | Shah | |
| 5,732,879 | A | 3/1998 | Low | |
| 5,737,934 | A | 4/1998 | Shah | |
| 5,823,006 | A * | 10/1998 | Jung | 62/291 |
| 6,012,296 | A | 1/2000 | Shah | |
| 6,269,650 | B1 | 8/2001 | Shaw | |
| 6,360,550 | B2 | 3/2002 | Klapp et al. | |
| 6,361,431 | B1 | 3/2002 | Kawano | |
| 6,427,461 | B1 * | 8/2002 | Whinery et al. | 62/176.6 |
| 6,557,771 | B2 | 5/2003 | Shah | |
| 6,619,053 | B1 | 9/2003 | Paul | |
| 6,711,470 | B1 | 3/2004 | Hartenstein et al. | |
| 6,826,921 | B1 * | 12/2004 | Uselton | 62/176.6 |

FOREIGN PATENT DOCUMENTS

JP 2003130399 A * 5/2003

* cited by examiner

*Primary Examiner*—Chen-Wen Jiang
(74) *Attorney, Agent, or Firm*—Stites & Harbison PLLC; Richard S. Myers, Jr.

(57) ABSTRACT

A system for controlling temperature and humidity in an enclosure, that has a central air conditioning system; a dehumidifier attached to a return air duct of the central air conditioning system; and a system control unit that comprises a thermostat, dehumidstat and can control a cooling solenoid valve to provide temperature control, and control a dehumidifier solenoid valve to provide humidity control. The cooling solenoid valve and the dehumidifier solenoid valve can be independently activated based on the temperature and humidity of the enclosure. Embodiments of the present invention include systems that are easily modify existing air conditioning systems.

16 Claims, 6 Drawing Sheets

Central Air Conditioner
40
42
Ref. Lines
50
Supply Air
44
Return Air
46

16
40
50
33
20
32
30
18
10
14
46
18
25

CLIMATE CONTROL AND DEHUMIDIFICATION SYSTEM AND METHOD

PRIORITY INFORMATION

This application claims benefit to U.S. Patent Application Ser. No. 60/589,309, filed Jul. 20, 2004, the contents of which are incorporated herein by reference.

FIELD OF THE INVENTION

The present invention relates to a system and method for controlling the indoor climate of an enclosed space, such as a room. More particularly, the present invention is related to a system and method for monitoring and controlling the both air temperature and humidity in a room.

Glossary

Sensible Cooling Load: the heat gain of the home due to conduction, solar radiation, infiltration, appliances, people, and pets. Illuminated light bulbs, for example, add only sensible load to the house. This sensible load raises the dry-bulb temperature.

Dry-Bulb Temperature: the temperature measured by a standard thermometer.

Latent Cooling Load: the net amount of moisture added to the inside air by plants, people, cooking, infiltration, and any other moisture sources. The amount of moisture in the air can be calculated from a combination of dry-bulb and wet-bulb temperature measurements.

Wet-Bulb Temperature: when a wet wick is placed over a standard thermometer and air is blown across the surface, the water evaporates and cools the thermometer below the dry-bulb temperature. This cooler temperature (called the wet-bulb temperature) depends on how much moisture is in the air.

Design Conditions: cooling loads vary with inside and outside conditions. A set of conditions specific to the local climate are necessary to calculate the expected cooling load for a home. Inside conditions of 75° F. and 50% relative humidity are usually recommended as a guidelines. Outside conditions are selected for the 2.5% design point.

2.5% Design: outside summer temperatures and coincident air moisture content that will be exceeded only 2.5% of the hours from June to September. In order words, 2.5% design conditions are outdoor temperatures historically exceeded 73 out of the 2,928 hours in these summer months.

Capacity: the capacity of an air conditioner is measured by the amount of cooling a unit can perform when running continuously. The total capacity is the sum of the latent capacity (ability to remove moisture from the air) and sensible capacity (ability to reduce the dry-bulb temperature). Each of these capacities is rated in Btu's per hour (Btu/h). The capacity depends on the outside and inside conditions. As it gets hotter outside (or cooler inside) the capacity drops. The capacity at a standard set of conditions is often referred to as "tons of cooling."

Tons of Cooling: air conditioner capacity is rated at 95° F. outside with an inside temperature of 80° F. and 50% elative humidity. Each ton of air conditioning is nominally 12,000 Btu/h (this comes from the fact that it takes 12,000 Btu to melt a ton of ice). While an air conditioner may be called a three ton unit, it may not produce 36,000 Btu/h in cooling. There is a wide variety of actual capacities that are called "three tons."

Manual J: a widely accepted method of calculating the sensible and latent cooling (and hearing) loads under design conditions. It was jointly developed by the Air Conditioning Contractors of Americas (ACCA) and the Air-Conditioning and Refrigeration Institute (ARI).

BACKGROUND OF THE INVENTION

Methods of controlling the indoor climate in a room have been known for a long period of time. Primarily, these systems include air conditioners that have thermostats to control the operation of the air conditioner using a dry bulb temperature. A typical controller in air conditioning mode causes the air conditioning to begin operation when the temperature rises above the set point value. The air conditioner responds by injecting cold air into the enclosure until the temperature within the enclosure has fallen to a point below the set value.

It is also well known that an air conditioner removes humidity from the air as well as cools it. Typically, in order to remove humidity from the air, prior art systems must lower the temperature of the air less than the current due point temperature, the temperature at which water condenses the air.

However, with this system there are situations where humidity levels are still too high, resulting in an uncomfortable space.

Attempts to remedy this problem have not been totally successful.

For example, previous attempts to control the relative humidity in enclosures have been made by simply adding a relative humidity sensor to the thermostat and then controlling the air conditioner to hold the relative humidity within the selected point range. A problem with this approach is that the relative humidity of the enclosure air may actually rise as the air is cooled and dehumidified within the enclosure. This is because the relative humidity is a function of both the amount of water vapor in a given volume or mass of air and its dry bulb temperature. Relative humidity for any volume of air is defined as the ratio of the partial pressure of the water vapor in the air to the vapor pressure of saturated steam at that temperature. Since the vapor pressure of saturated steam drops rapidly within a temperature, a relatively small amount of water vapor and volume of air at a lower temperature can result in 100% relative humidity. Thus it is possible to have a run-a-way situation where the humidity control function in a thermostat continues to call for further dehumidification, and as the temperature within the enclosure falls, relative humidity rises and locks the air conditioning on.

Subsequent attempts to solve the problem of high humidity have involved controlling the dew point temperature of enclosure air independently of the dry bulb temperature. See U.S. Pat. No. 4,105,063 to Bergt and U.S. Pat. No. 4,889,280 to Grald and MacArthur, both patents being incorporated herein by reference. However, these systems are deficient in that the achieved enclosure temperature is not always comfortable, and having a potential for over-cycling of the cooling system. Additionally, none of the references listed above provide dehumidification after the dry-bulb temperature set point has been achieved.

Other climate control systems have included using a humidity sensor, and a dry bulb temperature sensor in the enclosure. See U.S. Pat. Nos. 5,737,934 and 5,675,979. Control of humidity using a reheat system which re-heats chilled air in order to keep the dry bulb temperature of an enclosure to a specific set point is disclosed in U.S. Pat. No. 6,012,296. Another invention on the subject of temperature and humidity control has emphasized using the numerically larger of the dry bulb and humidity temperature errors. An indoor climate controller system adjusting both dry-bulb temperature and wet-bulb or dew point temperature in an enclosure is disclosed in U.S. Pat. No. 5,346,129 and is incorporated herein by reference.

Additionally, U.S. Pat. No. 6,557,771, incorporated herein by reference, discloses a system that has a controller that continuously monitors the dry bulb temperature error and the humidity temperature error within the enclosure and controls the ON/OFF status of the cooling device based on the following criteria: a) if the humidity temperature error is less than or equal to zero, the dry bulb temperature error is used in a conventional PID (proportional, integral, derivative) control block to control the ON/OFF status of the cooling device, modifying the enclosure temperature and humidity; or b) if the humidity temperature error is greater than zero, the dry bulb temperature error is ignored regardless of its magnitude and the humidity temperature error is used in a conventional PID control block to control the ON/OFF status of the cooling device; or c) if both the humidity temperature error and the dry-bulb temperature error are less than zero, the numerically larger of the humidity temperature error and the dry-bulb temperature error is used in a conventional PID control block to control the ON/OFF status of the cooling device. In the system of '771, both the humidity temperature error and the dry bulb temperature error use the same PID control block and controller gains to prevent any sporadic equipment operation.

Other prior art attempts include U.S. Pat. No. 4,105,063, incorporated herein by reference, which uses a system that obtains its reheat from supermarket freezers and is mixed into the central heat and air units to dehumidify the air along with supplemental electric heaters.

U.S. Pat. No. 4,876,858 discloses a dehumidification system of a variable volume chiller in commercial buildings using chilled water.

The present inventions is advantageous over the prior because it meets design conditions in proportion of sensible and latent heat loads from minimum to peak load with, in certain embodiments, sensible control having priority using the refrigeration cycle of reheat.

In a conventional cooling system entering air to the cooling coil operating at a given temperature will remove both sensible and latent heat. Residential air conditioning systems are controlled purely on room temperature, a measure of sensible heat, and therefore relative humidity is only changed as a by product. It is not controlled independently of temperature. This is particularly noticeable in humid climates in off peak conditions. The exterior dew point is highest early in the morning. The temperature in the enclosure may not be cold enough to trigger the air conditioning system, but the enclosure is more humid (and thus less comfortable than desired.

In view of the above, it is apparent that there is a need to provide a more reliable and efficient system for controlling a climate, including the control of temperature and humidity. The present invention meets that need.

The capacity of the air conditioner is designed for operation during the few hours of peak time. At lower temperatures the air conditioner will cycle and operate at less than full potential. With shorter cycles, the cooling coil (evaporator) does not have time for the temperature to fall to the dew point in a short cycle. For example, when the central air conditioning system stops cooling, the moisture collected on the evaporator, evaporates back into the indoor space with the extended Blower Cycles of today.

It is important that the air conditioner be sized to achieve the longest run times possible to bring humidity to acceptable levels in the building space.

Most of the cooling season, the cooling loads are well below the capacity of properly sized air conditioners and for oversized units, short cycling is a substantial problem. The building space becomes cold and clammy.

Without being bound by theory, the basic dilemma stems from trying to control two variables, temperature and relative humidity with just temperature control. The humidity level is a moving target that is only hit during peak design conditions resulting in indoor humidity levels above 60% relative humidity, a level recommended to control microbial growth.

OBJECTS AND SUMMARY AND OF THE INVENTION

An object of the present invention is to provide an effective system and method for controlling temperature and humidity in an enclosure.

Another object of the present invention is to provide a system that improves the refrigerant cycle of an air conditioner. The system of this embodiment will automatically adjust between the two variables of temperature and humidity.

Another object of the present invention is to provide a dehumidifier that can be added to an existing system, has a low cost of operation, and is simple in design.

Another object of the present invention is to provide a system to monitor and control temperature and humidity for an air conditioning installation. However, embodiments of the present invention could be used in the operation of other mechanical cooling devices such as a heat pump operating in the cooling mode, a geothermal unit and the like.

These and other objects of the present invention will be apparent from this disclosure.

In summary, the present invention relates to a system and method in the refrigerant cycle of an air conditioner. This system will automatically adjust is self to design temperature between the two variables of temperature and humidity.

In embodiments of the present invention, the system of the preset invention can be added to an existing cooling system. The existing air conditioning system is controlled by temperature, the dehumidifier is controlled by the relative humidity in the space.

In embodiments of the present invention, temperature has primary control. In these embodiments, when the temperature settings are met, the dehumidifier control drops the central unit fan to low speed and the dehumidifier keeps running until a predetermined relative humidity value is met in the enclosure. If during that time, the cooling is required as per a predetermined thermostat temperature setting, it may override and turn off the dehumidifier control. The air conditioner will then resume as normal.

DESCRIPTION OF THE INVENTION

Figure 1:
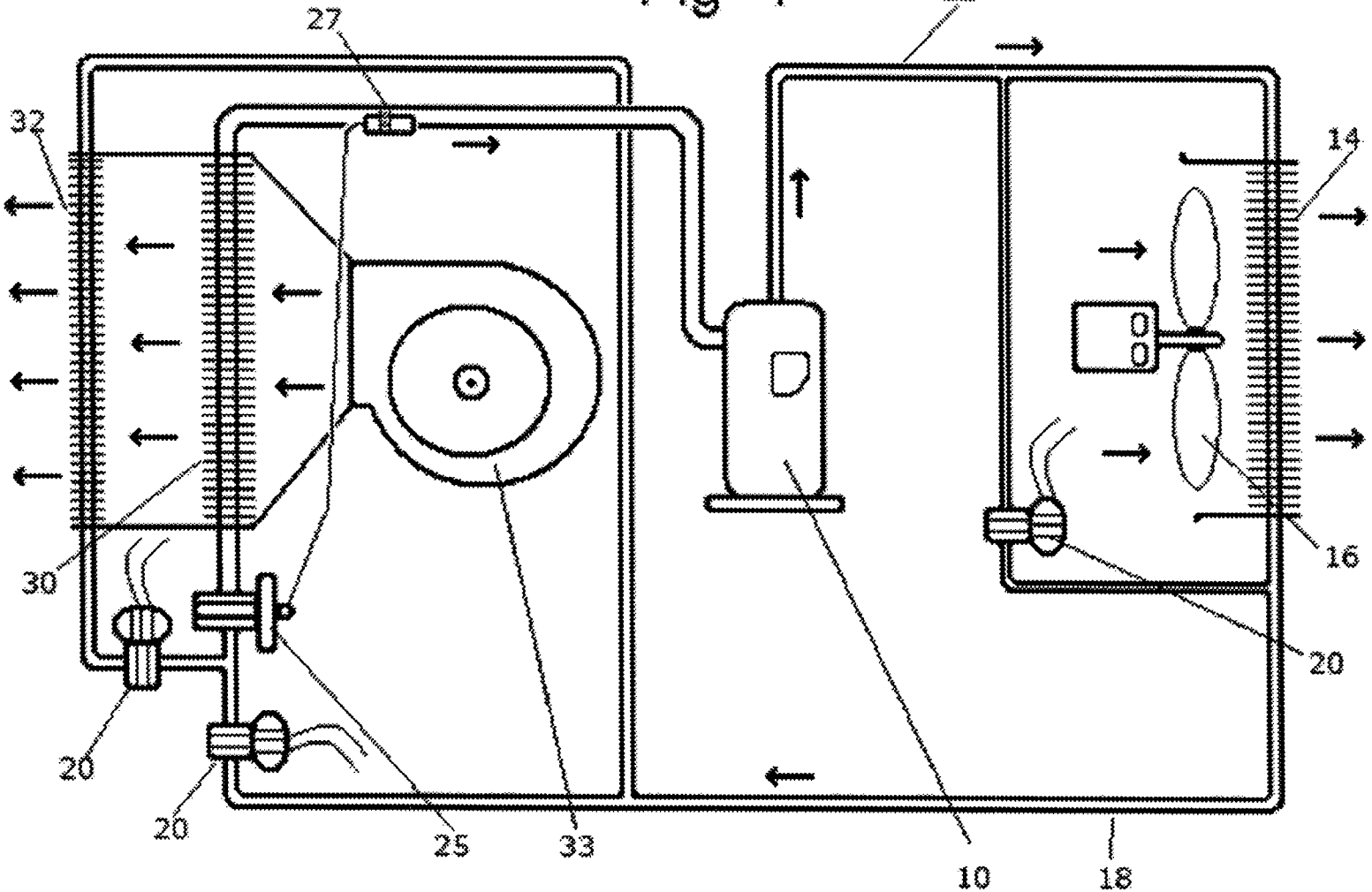
FIG. 1 shows a schematic drawing of a refrigeration circuit of the present invention.

As stated above, the present invention controls the temperature of an enclosure through temperature and humidity control. One aspect of the present invention is a central air conditioning system that includes a fan, dehumidifier attached to a return air duct of the central air conditioning system. The system control unit can comprise a thermostat, dehumidistat and can control a cooling solenoid valve to provide temperature control, and control a dehumidifier solenoid valve to provide humidity control. Typically, the cooling solenoid valve and the dehumidifier solenoid valve can be independently activated based on the temperature and/or humidity of the enclosure. Also in this embodiment, the central air conditioner is typically configured to circulated air through the supply duct, return duct, and dehumidifier re-heating coil.

Another aspect of the present invention is a method of modifying a central air conditioning system, by adding a dehumidifier re-heating coil, an evaporator coil, dehumidifying valve, cooling valve, blower fan, etc. This system includes a control unit that has a cooling sensor, and a dehumidifying sensor. Typically, the system will circulate air from the enclosure through the return air duct, the dehumidifier re-heating coil, the supply air duct, and back to the enclosure. The control unit may direct the operation of the central dehumidifier based on a settable, pre-determined humidity value and independently controlling the cooling operation based on a settable temperature value. In some aspects of the invention, when the temperature of the enclosure is reduced to a pre-determined temperature value, and the relative humidity of the enclosure is above a pre-determined humidity value, the compressor directs coolant to the central dehumidifier re-heating coil. Also, when cooling is needed to reach a pre-determined temperature for the enclosure, the control unit can override the operation of the dehumidifying unit to operate the central air conditioning system.

Another aspect of the present invention is a method of controlling temperature and humidity in an enclosure with an existing central air conditioning system that includes the steps of adding a system control that has a thermostat and dehumidistat, and a dehumidifier unit to the return air duct of an existing central air conditioning system; setting the thermostat to a selected temperature or temperature range; setting the dehumidistat to a selected humidity or humidity range. The temperature of the enclosure can be controlled to maintain the selected temperature or temperature range in the enclosure; and the humidity in the enclosure can be controlled to maintain the selected humidity or humidity range. During these controlling steps, the central air conditioning system fan circulates air through the supply duct, enclosure, return duct, and dehumidifier unit.

The system control unit allows for the controlling of the temperature step to be independent from the controlling the humidity step. Additionally, the system control may allow for the stoppage of the dehumidification steps during the time at which the air condition system is in operation.

Another aspect of the invention is a method of controlling a climate of an interior space that comprises providing a central air conditioning system that has a compressor, fan, supply air duct, and return air duct. Typically this system will be on that is pre-existing, such as a residential central air conditioner system. A system control unit is added and it includes at least a thermostat and dehumidistat. In this aspect, a dehumidifier unit that has an evaporator coil and a blower fan is attached to the return air duct. This aspect allows one to control the cooling function of the central air conditioning system based on the temperature in the interior space; while separately controlling the operation of the dehumidifier based on the humidity of the interior space.

During off peak climate control conditions a cooling function of the central air conditioning system can be interrupted, and the dehumidifier unit is operable in combination with the compressor of the central air conditioning system. Thus, the air conditioning system is circulating air through the enclosure and the air conditioning system without further cooling. At this point, the circulating air is dehumidified.

Turning now to the example of the present invention shown in FIG. 1, refrigerate is compressed by the compressor 10 into a hot hi-pressure gas and circulated through the hot gas tube 12 to the condenser coil 14. As air is pushed by the condensing fan 16 though the fins in the condenser coil, heat is dissipated, causing the hot gas to condense into a warm liquid under hi-pressure, this warm liquid circulates through the liquid tube 18 to a solenoid valve 20 that has been energized by the cooling t-stat.

From the solenoid valve, this hi-pressure liquid is forced through the expansion valve 25 or (restrictor pin) into the evaporator coil 30, thereby lowering the pressure and temperature. The expansion valve can be activated by the expansion valve bulb 27. The liquid refrigerant begins to evaporate into a cold gas extracting heat from the air circulating through the fins in the coil 30 being pushed by the blower fan 33. As the air temperature drops, moisture in the air forms in the fins of the evaporator coil 30 to dehumidify the air. The cold gas leaves the evaporator 30 to the compressor 10, where heat of compression changes the refrigerate back to hot hi-pressure gas.

Figure 2:
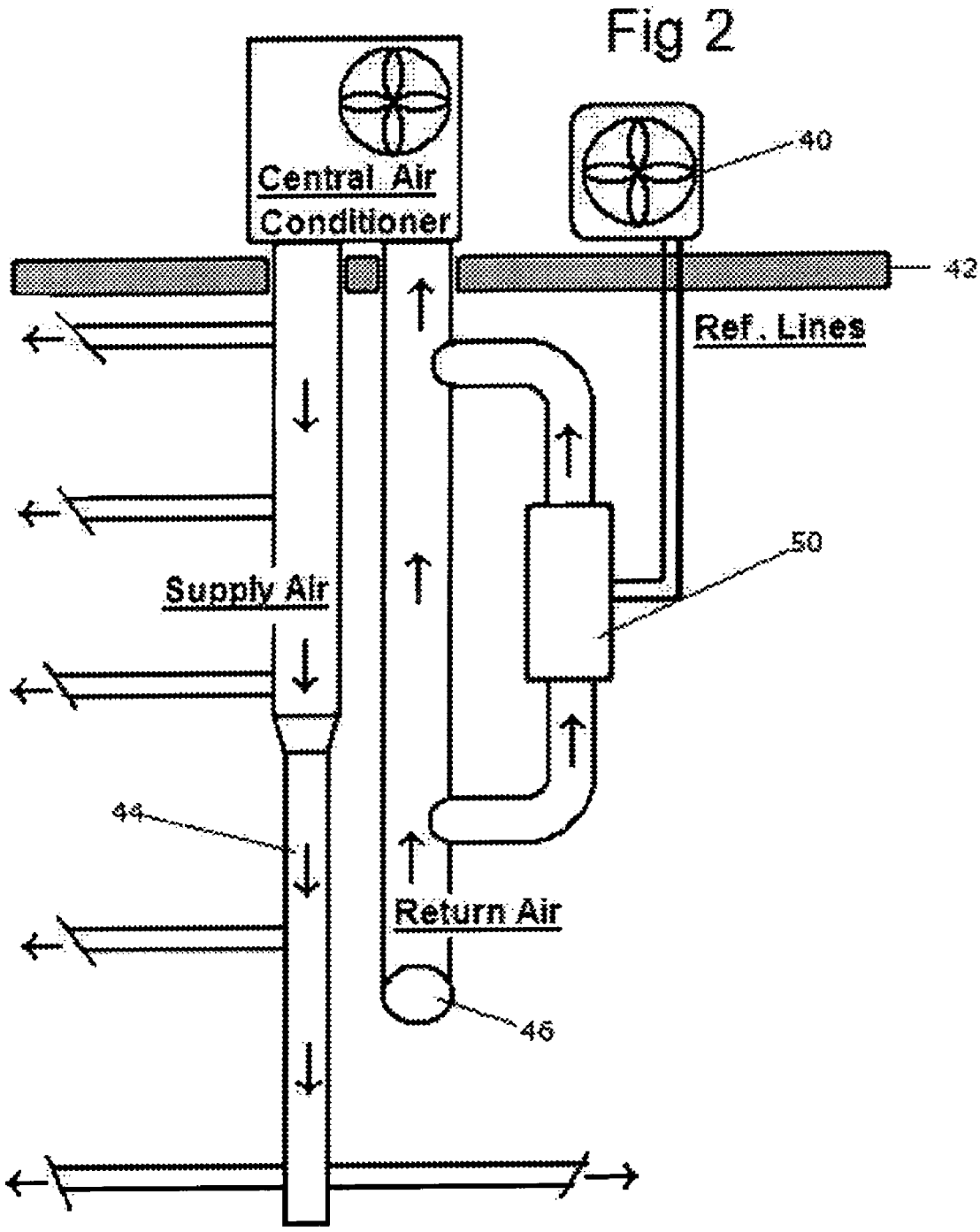
FIG. 2 shows a schematic drawing of a mechanical installation of the present invention.

For exemplary purposes only, an embodiment of the present invention can be made as shown in FIG. 2. Additionally, this example demonstrates how an existing system can be modified to arrive at the system of the present invention. An Amana brand 12 condensing unit 40 may be used and combined with adding a fan cycling switch, a hot gas by-pass solenoid valve, a blower with matching cooling coil, a 1.5 ton coil as the reheat device, and cooling and dehumidification solenoid valves as shown in FIG. 1. These parts of the system are easily obtainable by one of ordinary skill in the art. This unit is typically housed outside the wall 42 of a house or other building. The supply air duct 44 and return air duct 46 are shown. The dehumidifier 50 is shown as being attached to the return air ducts.

Figure 4:
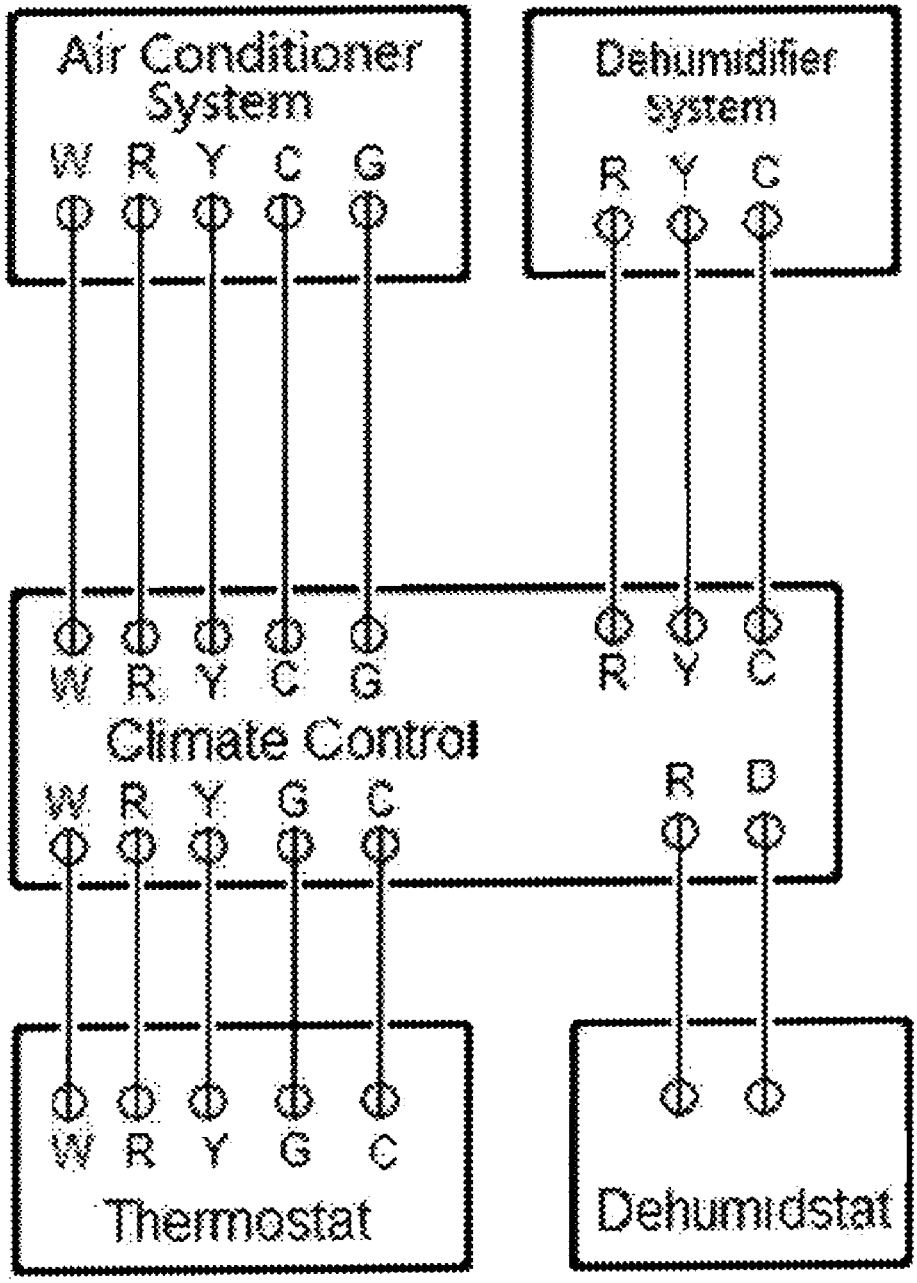
FIG. 4 a diagram for the low voltage control of embodiments of the present invention.
Figure 5:
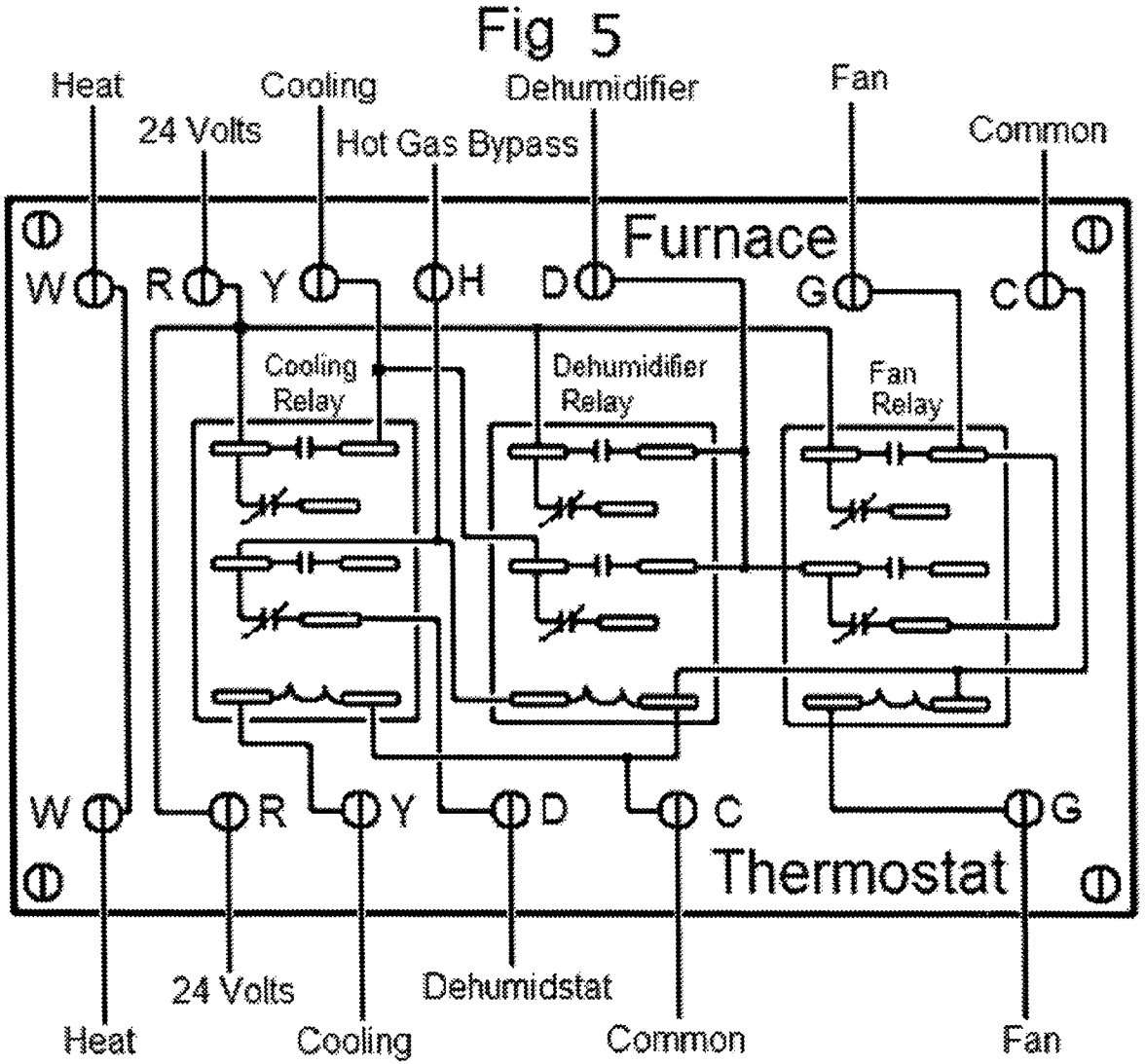
FIG. 5 shows an expanded view of an embodiment of the system control.

A controller/control unit as shown and described herein, including the example shown in FIG. 5 is wired with a thermostat and dehumidstat. See FIG. 4 as an example.

Figure 3:
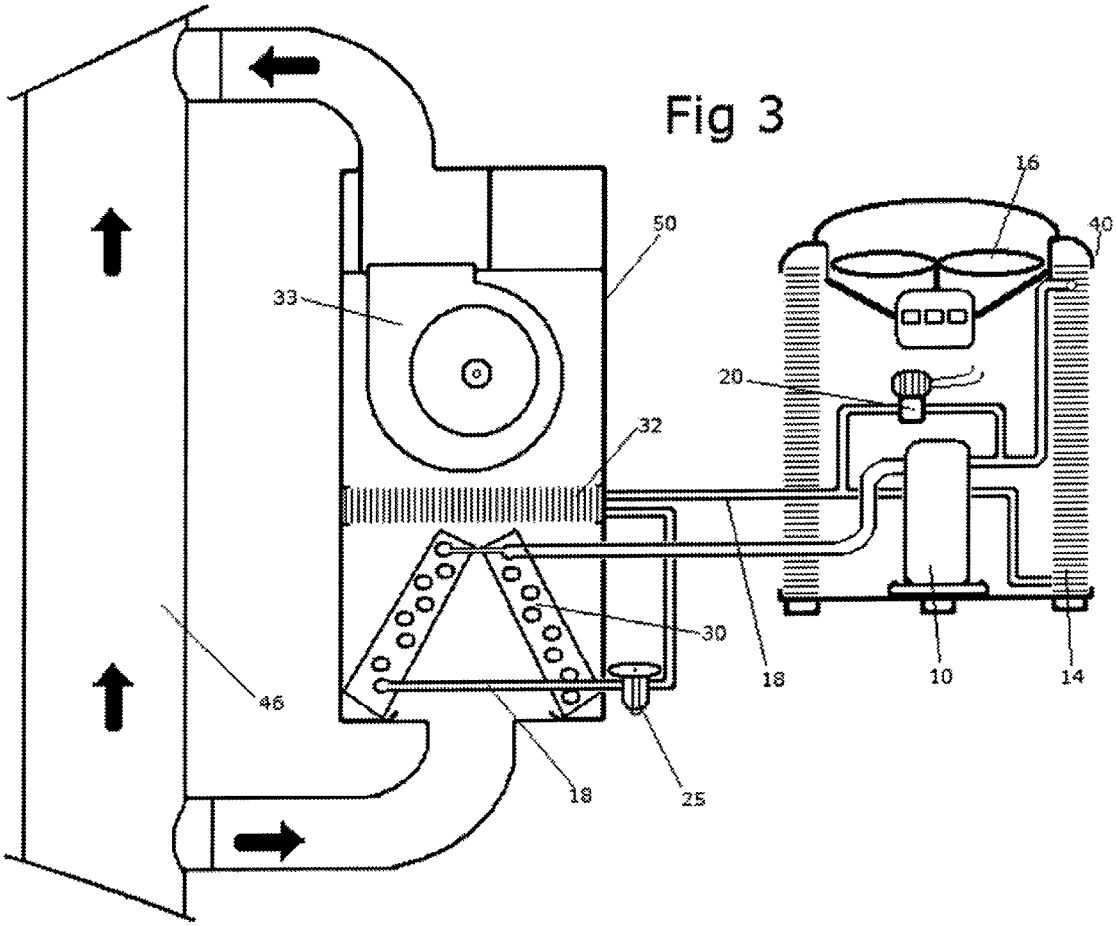
FIG. 3 shows an embodiment of the present invention added on a standard central air conditioning system.

FIG. 3 shows an expanded view of another example of the present invention where the dehumidifier 50 is attached to a return duct 46. The liquid lines 18, evaporator coils 30, and the outdoor condensing unit 40 are shown.

When the temperature in the building space has satisfied the thermostat, but the de-humidifier control says the relative humidity is still too high, the compressor keeps running but the cooling solenoid valve 20 is closed, forcing liquid refrigerate through the tube to the reheating coil 32, then to the expansion valve 25.

As this point, this example is primarily acting as a dehumidifier, by providing dehumidification with no temperature-based cooling. The air circulating through the coil is cooled dropping the temperature to the dew point to extract moisture then as the air is circulated through the reheat coil 32, the air is heated back to space temperature.

When the desired, predetermined relative humidity level is met, the control unit ends the dehumidification process ends. Additionally, if the temperature in the room reaches the thermostat setting temperature, dehumidification control unit end the dehumidification process, and thermostat control unit begins the cooling cycle. The cooling solenoid valve opens and dehumidifier solenoid value closes. As the unit starts cooling, the warm liquid refrigerant trapped in the reheat coil will quickly cool back down to cooling coil temperature.

In an additional embodiment, when, during the dehumidification process, the outside ambient air temperature drops the liquid refrigerant temperature below 75°, the hot gas solenoid opens and allows a metered amount of hot gas to bypass the condenser coil to elevate liquid temperature back to 85° F. as required to reheat.

Figure 6:
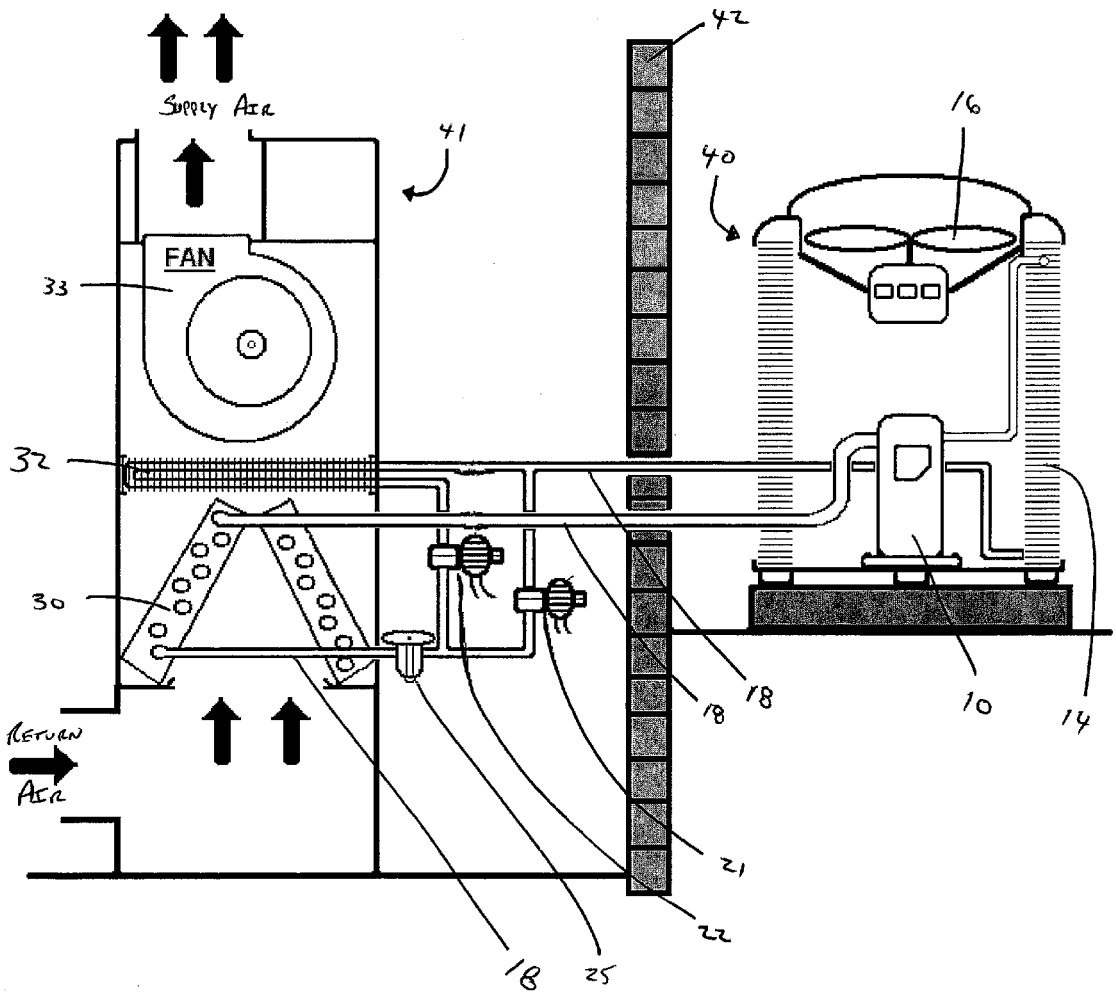
FIG. 6 shows a schematic drawings of an aspect of the present invention, wherein the improved central air conditioning system automatically adjusts between variables of temperature and humidity.

Another embodiment of the present invention is described further in FIG. 6, where a central air conditioning system that can automatically adjust between the two variables of temperature and humidity is shown. With this embodiment, as indicated above, during off peak climate control conditions a cooling function of the central air conditioning system can be interrupted by activating the re-heating coil, and the dehumidification function operates in combination with the compressor of the central air conditioning system. Thus, the air conditioning system is circulating air through the enclosure and the air conditioning system without further cooling. At this point, the circulating air is dehumidified. In the embodiment shown, the re-heating coil 32 is housed in the air handler 41. During the cooling function, the cooling solenoid 21 is open and the dehumidification solenoid 22 is closed. This arrangement interrupts or at least reduces the passage of the refrigerant liquid to the re-heating coil 32. When the enclosure reaches the desired temperature. The cooling function of the central air conditioner can be stopped. If the temperature inside the enclosure is at or below the desires temperature, but the humidity is at a higher than desired level, the system can operate in dehumidification mode, where the cooling solenoid 21 is closed and the dehumidification solenoid 22 is opened. This allows increased passage of refrigerant liquid to the re-heating coil.

The invention thus being described, it will be obvious that the same may be modified in many ways. All such modifications as would be obvious to one of ordinary skill in the art are intended to be included in the present invention and not a departure therefrom. All "aspects," "embodiments," and "embodiments" of the present invention discussed herein are examples of the present invention and should not be construed as limiting the scope of the present invention in any way of form.

Several patents and other publications are cited herein. All such patents and other publications are expressly incorporated herein by reference in their entirety.

I claim:

1. A central air conditioning system for controlling temperature and humidity in an enclosure, comprising:

a control unit that has a thermostat and a dehumidistat and can direct a cooling and dehumidification cycle and a dehumidification-only cycle;

a supply duct and a return duct;

an outdoor condensing unit that comprises a condenser unit and a fan;

an air handler disposed between the return duct and the supply duct that comprises a blower fan for circulating air into the supply duct, an evaporator coil, and a re-heating coil that maintains a refrigerant flood level from one cycle to the other;

refrigerant line system joining the compressor, evaporator coil, and the re-heating coil;

a cooling solenoid valve; and a dehumidifier solenoid valve downstream from the re-heating coil;

wherein the control unit, based on the temperature and the humidity of the enclosure, is capable of independently activating the cooling solenoid valve and the dehumidifier solenoid valve to direct refrigerant to the re-heating coil to allow for a dehumidification-only cycle within the enclosure while providing air to the supply duct that is substantially the same temperature as the air in the return duct, and wherein when the control unit independently activates the dehumidification solenoid to maintain refrigerant in the re-heating coil at a maintained flood level from one cycle to another cycle.

2. The system of claim 1, wherein re-heating coil is operable based on settable, pre-determined humidity value, and the cooling function of the system is independently operable based on a settable temperature value.

3. The system of claim 2, wherein, when the temperature of the enclosure reaches a pre-determined temperature, and the relative humidity is above a predetermined humidity, the control unit maintains the function of the air conditioner, and increases the temperature of the reheating coil by directing refrigerant there through, to maintain a more consistent air temperature between the air entering the air handler and the air leaving the air handler.

4. The system of claim 1, wherein the cooling solenoid is disposed on a refrigerant line between the compressor and the evaporator coil.

5. The system of claim 1, wherein the dehumidifier solenoid is disposed on a refrigerant line between the reheating coil and the evaporator coil.

6. The system of claim 1, wherein the cooling solenoid is disposed on a refrigerant line between the compressor and the evaporator coil, and the dehumidifier solenoid is disposed on a refrigerant line between the reheating coil and the evaporator coil.

7. The system of claim 6, wherein the refrigerant line system includes a reheating coil loop, with the flow of refrigerant through the reheating coil determined by the activation of the cooling solenoid and the dehumidifying solenoid.

8. A method of controlling a climate of an interior space, comprising:

(i) providing a central air conditioning system that includes:

a supply duct and a return duct;

an outdoor condensing unit that comprises a condenser unit and a fan;

an air handler disposed between the return duct and the supply duct that comprises a blower fan for circulating air into the supply duct, an evaporator coil, and a re-heating coil;

refrigerant lines joining the compressor, evaporator coil, and the re-heating coil;

a cooling solenoid valve;

a dehumidifier solenoid valve downstream from the re-heating coil; and a control unit that has a thermostat and a dehumidistat and is capable of independently activating the cooling solenoid valve and the dehumidifier solenoid valve to allow for a dehumidification-only cycle in the interior space and to provide a maintained flood level in the re-heating coil from one cycle to another cycle;

(ii) setting the thermostat to a selected temperature or temperature range;

(iii) setting the dehumidistat to a selected humidity or humidity range;

(iv) controlling the cooling function of the central air conditioning system based on the temperature of the interior space;

controlling the operation of the dehumidification unit based on the humidity of the interior space.

9. The method of claim 8, wherein the control unit, to operate the system in a cooling mode, opens the cooling solenoid and closes the dehumidification solenoid, to reduce passage of the refrigerant liquid to the re-heating coil.

10. The method of claim 8, wherein the control unit, to operate the system in a dehumidification mode, closes the cooling solenoid and opens the dehumidification solenoid, to allow increased passage of refrigerant liquid to the re-heating coil.

11. The method of claim 8, wherein when the temperature of the enclosure is reduced to a pre-determined temperature value, and the relative humidity of the enclosure is above a pre-determined humidity value, the control maintains the function of the air conditioner, and increases the temperature of the reheat coil to maintain a more consistent air temperature between the return air and the supply air.

12. The method of claim 8, wherein the controlling the cooling function step is independent from the controlling the humidity step, and wherein the operation of the controlling the temperature step is based on the temperature of the enclosure.

13. A method of controlling a climate of an interior space, composing:

providing a control unit that has a thermostat and a dehumidistat;

providing a central air conditioning unit;

providing a system of ducts that include a return duct;

providing a dehumidifier unit attached to and fed by a return air duct of the central air conditioning system, wherein the dehumidifier unit comprises: (i) a blower for returning air to the return duct, (ii) an evaporator coil, (iii) a re-heating coil for reheating the air returned to the return duct, (iv) a condenser that releases at least a portion of extracted heat outside the enclosure, (v) a compressor, (vi) cooling liquid lines joining the evaporator, re-heating coil, condenser and compressor, and (vii) a solenoid valve downstream from the re-heating coil;

setting the thermostat to a selected temperature or temperature range;

setting the dehumidistat to a selected humidity or humidity range;

controlling the cooling function of the central air conditioning system based on the temperature in the interior space;

controlling the operation of the dehumidifier based on the humidity of the interior space, wherein the control unit directs the follow of coolant through the dehumidifier evaporator coil and the dehumidifier re-heating coil based on the humidity level detected in the interior space, and wherein the control unit operates said solenoid valve downstream from the re-heating coil to maintain refrigerant in the re-heating coil at a maintained flood level from one cycle to another cycle.

14. The method of claim 13, wherein, when based on the temperature of interior space, cooling is required; and, when based on the humidity of the interior space, dehumidification is not required, the control unit operates the central air conditioning system and closes the dehumidifier unit solenoid.

15. The method of claim 13, wherein the controlling the cooling function step is independent from the controlling the dehumidifier step, and wherein the operation of the controlling the temperature step is based on the temperature of the enclosure.

16. The method of claim 13, wherein, when based on the temperature of interior space, cooling is not required; and, when based on the humidity of the interior space, dehumidification is required, the control unit prevents operation of the cooling function of the central air conditioning system and opens the dehumidifier unit solenoid.

* * * * *